United States Patent [19]

Gupta et al.

[11] 4,115,620

[45] Sep. 19, 1978

[54] CONJUGATE FILAMENTS

[75] Inventors: Rakesh Kumar Gupta; George Jurkiewitsch, both of Raleigh; Lawrence Joseph Logan, Cary, all of N.C.

[73] Assignee: Hercules Incorporated, Wilmington, Del.

[21] Appl. No.: 760,495

[22] Filed: Jan. 19, 1977

[51] Int. Cl.[2] ..... D02G 3/00

[52] U.S. Cl. ..... 428/374; 264/171; 428/369; 428/370

[58] Field of Search ..... 428/373, 374, 364, 369, 428/370, 371, 359, 362; 260/897 A; 264/171

[56] References Cited

U.S. PATENT DOCUMENTS

| | | | |
|---|---|---|---|
| 3,092,891 | 6/1963 | Baratti | 260/897 A |
| 3,121,070 | 2/1964 | Coover, Jr. et al. | 260/897 A |
| 3,173,163 | 3/1965 | Cramton | 260/897 A |
| 3,361,849 | 1/1968 | Cramer et al. | 260/897 A |
| 3,399,259 | 8/1968 | Brayford | 264/168 |
| 3,419,178 | 1/1970 | Nishioka et al. | 264/168 |
| 3,459,846 | 8/1969 | Matsui et al. | 264/171 |
| 3,505,164 | 4/1970 | Oppenlander | 428/370 |
| 3,509,013 | 4/1970 | Oppenlander | 428/373 |
| 3,533,904 | 10/1970 | Jurkiewitsch | 428/370 |
| 3,582,418 | 6/1971 | Schuur | 428/373 |
| 3,607,611 | 9/1971 | Matsui et al. | 428/374 |
| 3,657,062 | 4/1972 | Eshima et al. | 428/374 |
| 3,663,488 | 5/1972 | Kail | 260/897 A |
| 3,666,836 | 5/1972 | John | 260/897 A |
| 3,803,453 | 4/1974 | Hull | 428/375 X |

FOREIGN PATENT DOCUMENTS

| | | | |
|---|---|---|---|
| 679,797 | 4/1965 | Belgium | 428/373 |
| 9,533 | 5/1965 | Japan | 428/370 |
| 4,737 | 2/1967 | Japan | 428/370 |
| 14,415 | 6/1969 | Japan | 428/373 |
| 42,688 | 5/1970 | Japan | 428/370 |
| 4,554 | 6/1971 | Japan | 428/373 |
| 13,554 | 2/1973 | Japan | 428/374 |
| 979,083 | 1/1965 | United Kingdom | 428/370 |
| 1,259,034 | 1/1972 | United Kingdom | 428/374 |
| 1,293,851 | 10/1972 | United Kingdom | 428/370 |

*Primary Examiner*—Lorraine T. Kendell
*Attorney, Agent, or Firm*—Hazel L. Deming

[57] ABSTRACT

Conjugate filaments which exhibit a high degree of spontaneous crimp and good modulus are described. The filaments comprise at least 2 components, one of which being a blend of polypropylene with 5 to about 50% of certain low molecular weight hard resins derived from hydrocarbons having at least 4 carbon atoms or rosin derivatives and another component being polypropylene or a blend of polypropylene and a different amount of the hard resin or rosin derivative.

12 Claims, No Drawings

CONJUGATE FILAMENTS

This invention relates to synthetic yarns which exhibit a high degree of bulk or crimp and, more particularly, to polypropylene filaments and yarns which crimp or bulk spontaneously.

Most textile applications require the use of bulked yarns for aesthetic and economic reasons such as hand and covering power. There are numerous well-known mechanical methods, such as gear crimping and stuffer box crimping, for producing this bulk in separate processing operations. More recently, processes have been developed for producing self-bulking polypropylene yarns by conjugate spinning. Generally, the process for accomplishing this consists of spinning bicomponent filaments from polypropylene resins which differ in molecular weight, molecular weight distribution, isotactic index or birefringence. These differences result in as-spun filaments having two components dissimilar in morphological structure and/or molecular orientation. Drawing and subsequent heat relaxation result in different shrinkage characteristics of the two components thereby causing the filaments to assume a helical configuration. While these processes are capable of producing yarns having a high degree of bulk, there are certain disadvantages, outstanding of which is the tendency of the yarn to be chalky due to the formation of voids in the high shrinkage component of each filament.

It has also been suggested that bicomponent filaments can be spun from propylene polymers which differ in intrinsic modulus, such as, for example, a homopolymer of propylene and a copolymer of propylene with ethylene. Composite yarns therefrom, however, have lower moduli and hence limited utility. Any advantages realized in bulk or crimp by the use of propylene-ethylene copolymers are thus offset by poorer yarn quality.

Now, in accordance with this invention, it has been found that conjugate filaments which exhibit both a high degree of spontaneous crimp and good modulus can be formed from polypropylene by using a blend of polypropylene with certain hard non-crystalline resins as the polymeric material for at least one component of the conjugate. Accordingly, the present invention relates to a composite filament comprised of at least two components, one of said components being a blend of polypropylene and from 5 to about 50% of at least one hard, non-crystalline resin compatible with the polypropylene and having a drop softening point of at least 70° C. and another of said components being polypropylene or a blend of polypropylene and up to 50% of at least one of said resins, said resins being selected from the group consisting of low molecular weight resins derived from hydrocarbons having at least 4 carbon atoms and rosin derivatives, and, if present in two or more of said components, the amount thereof in the respective blends differing from each other by at least 5%. Furthermore, the conjugate filaments of this invention, after drawing and relaxation, assume a high degree of helical crimp without the accompanying voiding and consequent chalky appearance characteristic of some of the known conjugate filaments of the polypropylene type. The novel conjugate self-bulking filaments of this invention, and particularly yarns thereof, are well suited for a variety of textile applications where yarn texture and bulk are desirable and are adaptable for the manufacture of self-bonded nonwovens.

The polypropylene which is used in this invention can be any highly crystalline, fiber-forming polymer made wholly or predominantly from propylene. The polymers include crystalline polypropylene itself, otherwise called isotactic, or stereoregular polypropylene and the substantially crystalline copolymers of propylene with up to about 25% of a second alpha-olefin, e.g., ethylene, butene-1, etc. Thus, the term "polypropylene", as used herein, is intended to include both the homopolymer of propylene and the copolymers of propylene with up to 25% of one or more alpha-olefins. Such polypropylenes usually have an intrinsic viscosity (I.V.) measured in decalin solution at 135° C. using a viscometer capillary diameter of 0.44 mm. in the range of about 1.3 to about 4, and preferably from about 1.7 to about 3 (expressed as deciliters/gram), and a density of at least about 0.88. The polypropylenes used for each of the components of the composite filament can be alike or can differ in intrinsic viscosities, molecular weight distributions, isotactic content, and the like. The differences, however, should be relatively small so that void formation in the high shrinkage component is minimized and chalkiness does not occur.

As indicated, at least one of the components of the composite filament comprises polypropylene which has been alloyed or blended with a hard, non-crystalline, low molecular weight hydrocarbon type resin or rosin derivative which has a softening point of at least 70° C. and which, at the level used, is compatible with the polypropylene, i.e., does not exhibit phase separation under conditions of use. The low molecular weight hydrocarbon type resins contemplated for use herein include terpene polymers, hydrogenated terpene polymers, hydrogenated styrene polymers, and petroleum resins obtained by the catalytic polymerization of a mixture of monomers derived from the deep cracking of petroleum. The terpene polymers are the known, low molecular weight, polymeric, resinous materials, including the dimers obtained by polymerization and/or copolymerization of terpene hydrocarbons such as the alicyclic, monocyclic, and bicyclic monoterpenes and their mixtures, including allo-ocimene, carene, isomerized pinene, pinene, pyropinene, dipentene, terpinene, terpinolene, limonene, turpentine, a terpene cut or fraction, and various other terpenes, as well as the condensation type resins obtained by condensing various terpenes such as dipentene, pinene, limonene and various terpene cuts with phenols such as phenol, alkylated phenols such as cresol, n- or t-butyl phenol, propyl phenol and the like in the presence of known condensation-type catalysts. While any of the terpene polymers prepared by methods known to the art and having low average molecular weight and softening points of at least 70° C. (Hercules, drop method) are operable herein, the preferred terpene polymers which are particularly effective in providing the improvements in accordance with the invention are characterized by molecular weights from about 500 to about 2000 and softening points between about 100° and 195° C.

The hydrogenated terpene polymers can be any of the above-described polymers hydrogenated in a well-known manner as, for example, by the techniques described in U.S. Pat. No. 3,361,849 to Lorentz et al., issued Jan. 2, 1968. It is preferred that the terpene polymers utilized herein be hydrogenated because of the improved U.V. light stability and color obtained by hydrogenation and the resultant improvements in polymer stability during handling at elevated temperatures.

The styrene polymers which are useful in this invention are low molecular weight hydrogenated homopolymers of styrene or of alkyl substituted styrenes, copolymers of styrene and alkyl substituted styrenes, copolymers of alkyl substituted styrenes with each other and copolymers of styrene and alkyl substituted styrenes with other hydrocarbons having non-aromatic carbon-to-carbon unsaturation. The preferred hydrogenated styrene polymers are characterized by having a drop softening point between 70° and 170° C., by having at least about 50% of their aromatic unsaturation hydrogenated, and by having a number average molecular weight between about 600 and 10,000. The styrene polymers can be prepared in known manner as by polymerization in the presence of a Lewis acid such as $BF_3$ etherate or aluminum chloride and hydrogenation can be accomplished in accordance with standard and well known techniques for the hydrogenation of aromatic rings utilizing a nickel catalyst. The degree of hydrogenation of the aromatic ring is determined by measuring the decrease in intensity of the U.V. absorption band due to aromatic unsaturation at 266 millimicrons. The preferred styrene polymers are homopolymers of styrene or of alkyl substituted styrenes such as alpha-methyl styrene or vinyl toluene; copolymers of such monomers with each other such as, e.g., styrene—vinyl toluene copolymer, alpha-methyl styrene—vinyl toluene copolymer, or styrene—alpha-methyl styrene copolymer; copolymers of styrene and alkyl substituted styrenes with other hydrocarbons having non-aromatic carbon-to-carbon unsaturation such as terpenes, e.g., dipentene, carene, pinene, terpinene, limonene, turpentine, allo-ocimene and terpinolene, aliphatic alpha-olefins such as ethylene, propylene, butene-1, and the like, dienes such as butadiene, indenes, and the like.

The low molecular weight petroleum resins which are useful in this invention are the aliphatic, aromatic or mixed aliphatic-aromatic resins obtained by the catalytic polymerization of a mixture of monomers derived from the deep cracking of petroleum, which monomers are hydrocarbons having at least 4 carbon atoms and chiefly mono- and diolefins. The petroleum resins are commercially available and usually have softening points from 70° to about 195° C., preferably from about 100° to about 180° C., and molecular weights within the range of about 350 to about 2000, preferably from about 400 to about 1400. If desired, the petroleum resins can be hydrogenated conventionally to reduce any unsaturation and improve their color and light stability. Typical of the petroleum resins are the aromatic hydrocarbon resins derived from petroleum sources and commercially available as the Picco 6000 Resins of Hercules Incorporated and the aliphatic hydrocarbon resins derived from mixed monomers of petroleum origin and commercially available as the Piccotac A, B and C Resins of Hercules Incorporated.

As stated above, the resin which is blended with the polypropylene can also be a rosin derivative. The rosin derivatives which can be employed in this invention are amorphous, hard, brittle, solid resins at room temperature, have a softening range at elevated temperature, a drop softening point of at least 70° C., and are compatible with the polypropylene. Such rosin derivatives can be prepared from gum rosin, wood rosin, or tall oil rosin, all of which are commercially available. The rosin derivatives of this invention are known materials, which have been adequately described in the technical and patent literature. Many are commercial products. For a clear understanding of the nature and chemistry of rosin and rosin derivatives, there is an excellent technical description in the *Encyclopedia of Chemical Technology,* Volume 11, pages 779–810, copyright 1953, by Interscience Encyclopedia, Inc., entitled "Rosin and Rosin Derivatives", by George C. Harris. The contents of this encyclopedic reference, together with the patent and technical literature references cited therein, are hereby incorporated hereinto by reference.

The rosin derivatives which are preferred for the purposes of this invention can be grouped into six classes. The first of these classes comprises rosins which have been modified by hydrogenation, disproportionation, polymerization, condensation with unsaturated carbocyclic compounds to form resinous condensation adducts, or combinations of such modifying treatments. Some typical representative members of this class include hydrogenated rosin, disproportionated rosin, polymerized rosin, specifically dimerized rosin, hydrogenated disproportionated rosin, hydrogenated dimerized rosin, condensation adducts of rosin with styrene, divinyl benzene, diisopropenyl benzene, alpha-methyl-p-methyl-styrene or cyclopentadiene, as well as the hydrogenated condensation adducts thereof.

The second of these classes comprises the individual resin acids which are the resin acid components of the hydrogenated rosin and disproportionated rosin of the first class. The principal members of this class include dihydroabietic acid, tetrahydroabietic acid, dehydroabietic acid, dihydrodextropimaric acid, tetrahydrodextropimaric acid, dihydroisodextropimaric acid, and tetrahydroisodextropimaric acid. These individual resin acids may be isolated by the amine salt method described in the article entitled "An Improved Method for Isolation of Resin Acids; The Isolation of a New Abietic-Type Acid, Neoabietic Acid", by George C. Harris and Thomas F. Sanderson, "J. Am. Chem. Soc.", 70. 334 (1948). These individual resin acids may be mixed together in any desired combination, and this invention contemplates the use not only of the individual resin acids per se, but also mixtures of the individual resin acids in any desired combination.

The third of these classes comprises the hydroabietyl alcohol esters of the modified rosins of class (1) above and the resin acids of class (2) above. Some typical representative members of this class include the hydroabietyl alcohol ester of hydrogenated rosin, disproportionated rosin, dihydroabietic acid, tetrahydroabietic acid, dehydroabietic acid, and the like. Hydroabietyl alcohol may be prepared by the hydrogenolysis of the methyl ester of rosin at 300° C. and 5000 p.s.i. in the presence of copper chromite catalyst in accordance with the process described in U.S. Pat. Nos. 2,358,234 and 2,358,235 to W. A. Lazier. Conventional methods of esterification may be employed to prepare the esters, keeping in mind that the structurally hindered nature of the resin acid carboxyl group makes it necessary to use higher temperatures, on the order of 250°–300° C., and that means to remove water formed by the esterification reaction should be provided.

Di-rosin amine which constitutes the fourth class of rosin derivatives may be prepared by the hydrogenation of rosin nitrile over a nickel catalyst at temperatures above about 200° C. with removal of ammonia. It may also be prepared from rosin amine by heating in the presence of a nickel catalyst, removing ammonia as it is formed.

The monoamides which constitute the fifth class of rosin derivatives may be prepared by reacting a modified rosin of class (1) above or a resin acid of class (2) above with an amine derived by the ammonolysis of a modified rosin of class (1) above or a resin acid of class (2) above. Some typical representative members of this class include N-dehydroabietyl hydrogenated rosin amide, N-dihydroabietyl hydrogenated rosin amide, N-tetrahydroabietyl hydrogenated rosin amide, N-dehydroabietyl disproportionated rosin amide, N-dihydrodextropimaryl dimerized rosin amide, N-dehydroabietyl dihydroabietic acid amide, N-dihydroabietyl dehydroabietic acid amide, N-tetrahydroabietyl tetrahydroabietic acid amide, and the like.

The diamides which constitute the sixth class of rosin derivatives may be prepared by reacting ethylene diamine with a modified rosin of class (1) above or a resin acid of class (2) above at high temperatures in the range of 250°-300° C. under high vacuum to remove volatile by-products by "topping". Some typical representative members of this class include the diamide of hydrogenated rosin and ethylene diamine, the diamide of disproportionated rosin and ethylene diamine, the diamide of dehydroabietic acid and ethylene diamine, the diamide of tetrahydroabietic acid and ethylene diamine, and the like.

The amount of hard resin that is blended with the polypropylene ranges from 5 to 50%, and preferably from about 10 to about 30% by weight of the blend. An amount below about 5% by weight of the hard resin is insufficient to give the desired bulk and self-bonding characteristics to the fiber and amounts above about 50% do not provide additional advantages, and may, in some cases, adversely affect processability and fiber characteristics such as tensile strength, elongation, modulus, creep, light stability, etc.

The properties of the polymers of propylene employed in the various components of the conjugate filaments are not critical for use in this invention in any way that they are not critical for typical synthetic filament applications. Thus, the density limits specified above are those normally contemplated for any filament application. The same is true of the intrinsic viscosity range of about 1.3 to 4.

As is also usually the case with polypropylene in more traditional synthetic filament applications, heat stabilizers, light stabilizers and antioxidants are also included in the formulations. Any of the stabilizer-antioxidant systems normally employed for this purpose can be used. These are well known to the art and need not be discussed here. Other additives such as dyeing adjuvants, pigments and fillers can also be included.

The ratio of the components in the conjugate filaments of this invention where two components are used will generally vary from about 1 to 4 to about 4 to 1. Usually, however, the filaments will be comprised of about equal portions of each component. The different components of the filaments can be arranged in either side-by-side or sheath-core configuration.

Generally speaking, the preparation of the filaments is accomplished according to standard methods except for the simultaneous spinning of a multiplicity of polymer streams. That is to say, the polymer is extruded under pressure in the form of a melt through an orifice and subjected to a substantially low orienting melt draw-down whereby the thickness of the filament is reduced. Thereafter, the shaped filament is subjected to an orienting draw and the drawn filament is heated in a substantially tension-free state to develop crimp.

Spinning equipment suitable for preparing filaments of either of these configurations is well known in the art and forms no part of this invention. For disclosures of equipment for forming these filaments, reference can be had to U.S. Pat. Nos. 3,192,562, 3,181,201, 3,176,346, 3,176,345, 3,176,343, 3,176,342, 3,161,914 and many others.

The basic design feature of these spinnerets is the provision of polymer in more than one stream with the streams converging and contacting each other at a point at or immediately before the extrusion orifice. Specific spinneret design determines whether the resulting filament possesses the side-by-side or sheath-core configuration. Contact between the streams is always made while the polymer is molten so that the several components can fuse into a single, well adhered composite structure upon cooling. Spinning can be accomplished at a temperature from about 190° to about 325° C., and preferably from about 220° to about 280° C.

In most cases, spinning is effected through a spinneret having a plurality of conjugate orifices in its face. The resulting plurality of conjugate filaments is usually collected together into a yarn which is then subjected to the remainder of the treatment steps as an entity. When the yarn has undergone the drawing and relaxation steps, it assumes substantially greater bulk due to the helical coil or crimp imparted to the individual filaments.

The orienting draw is conducted at a temperature below the melting point of the polypropylene in order to develop the optimum properties of the filaments. Preferably, the drawing temperature will be between about 25° and about 110° C. in order to develop the optimum in tensile properties and also to develop the necessary differential shrinkage potential. A draw of at least about 150% is usually required to produce sufficient shrinkage to result in useful crimped filaments or yarn. Drawing can be carried out with or without partial heat setting to control fiber linear shrinkage and texture development. Drawing is effected according to techniques well known to the art. A preferred method is drawing in the narrow gap between differentially driven feed and draw rolls. Heat is applied to the feed roll to heat the yarn to the proper drawing temperature, while the draw roll is normally maintained at about room temperature. In some cases, the draw roll can be heated, if desired.

Following drawing, crimp is developed by permitting the filaments to relax under very low tension and generally at less than 0.001 gram/denier, while heating. Heat treatment can be effected in a batch operation, as for example, in a heated bath or in an oven, using temperatures which generally range between about 90° and 150° C. and times from about 0.2 to 10 minutes. It is also possible to carry out the heat treatment continuously by bringing the yarn, moving at a high speed, e.g., 100 to 1000 meters per minute, into contact with a hot plate or by passing the yarn through a heated zone. In the case of contact heating at high rates of yarn travel, the exposure time of the yarn to the heat treatment will usually be less than during a batch operation and, accordingly, higher temperatures are employed. Temperatures as high as 300° C. will permit absorption of sufficient heat to effect shrinkage during very short contact periods, such as 0.01 second or more. Using this mode of operation, however, provision must be made to allow shrinkage of the yarn without appreciable tension development. If tension develops, the yarn will either break or heat set so that no bulk at all will develop. Texture development and shrinkage control can also be accomplished by chemical treatment in the finishing process, as for example, by treatment with such conventional solvents as trichloroethylene, perchloroethylene, or the like.

The filaments prepared according to this invention have a crimp potential of about 10 to 120 or more, depending upon composition, fiber processing temperatures and filament geometry. Crimp potential, as used herein, refers to the inherent crimping tendency of the conjugate fiber, normalized for the fiber denier. Thus, the crimp potential (CP) is described by the equation $$CP = (CPI)\,(\sqrt{\text{denier/filament}})$$

where *CPI* is the crimp frequency measured as the number of crimps per inch of straight fiber. Crimp frequency is determined by counting the number of crimps between two arbitrary marks on a crimped fiber and then dividing the number by the stretched out (straight) length in inches between the marks. Usually a satisfactory bicomponent filament will have a bicomponent crimp potential (BCP) of about 20 to about 100.

The invention is illustrated by the following examples in which parts and percentages are by weight unless indicated otherwise. The softening point of the resin is that temperature (° C.) at which the resin changes from a rigid to a soft state, as determined by the Hercules drop method (described in Hercules report entitled "The Hercules Drop Method for Determining the Softening Point of Rosins and Modified Rosins", No. Herc. 400–431C, (1955)), unless otherwise indicated.

EXAMPLE 1

A first component was prepared by blending 25 parts of pulverized hydrogenated polyterpene resin with 75 parts of polypropylene resin and extruding the blend into pellets. The polypropylene resin had an intrinsic viscosity of 2.4, a density of 0.905, and contained 0.5%, based on the total sample weight, of a stabilizer combination comprising the acid-catalyzed reaction product of 2 moles of nonylphenol and 1 mole of acetone, the reaction product comprising a mixture of isopropylidene-bis-(nonylphenol), and 2-(2'-hydroxyphenyl)-2,4,4-trimethyl-5,6'-dinonylchroman and 0.1% of calcium stearate. The hydrogenated polyterpene resin had a softening point of 118° C., an average molecular weight (Rast) of about 790 and an iodine value of 17. A second component containing only the stabilized polypropylene resin was also prepared.

The above first and second components were then melted separately and fed by separate extruders and metering pumps to a bicomponent fiber spinning head of round cross-section operated at 250° C. and spun as conjugate filaments, the components being disposed side-by-side in a 50:50 relationship. The spun filaments were drawn down and packaged as 9 denier per filament (d.p.f.) yarns (each yarn containing 35 filaments) at 940 ft./min. The spun yarn was drawn 3.0X using differentially driven feed and draw rolls, the feed roll temperature being about 110° C. and that of the draw roll being about 140° C., and then was packaged under sufficient tension to prevent contraction of the yarn. The drawn denier was 3.0.

The yarn was then heat treated under zero tension in a hot air oven for 10 minutes at about 141° C. The heat treated yarn had a crimp frequency of 55, a bicomponent crimp potential of 95, a Young's modulus of 30.8 grams/denier and could be self-bonded at temperatures of about 147° C. Visual inspection of the yarn indicated that no void formation had taken place as a result of the drawing.

EXAMPLE 2

The procedure of Example 1 was repeated using the same components and conditions as in Example 1 except as hereinafter noted. The conjugate filaments were drawn down and packaged as 11 d.p.f. yarn at 760 feet per minute. The yarn was drawn 3.7X using differentially driven feed and draw rolls, the feed roll temperature being about 110° C. and that of the draw roll being about 30° C. The yarn had a drawn denier of 3.0 and was heat treated in a hot air oven at 130° C. under zero tension for 10 minutes. The yarn developed a crimp frequency of 49, had a bicomponent crimp potential of 85, and a Young's modulus of 35.8 grams/denier and was self-bonding at a temperature of 147° C. Visual inspection of the yarn indicated that no void formation had taken place as a result of the drawing.

EXAMPLE 3

Yarn was prepared as in Example 1 with the exceptions that 25 parts of a glycerin ester of hydrogenated rosin having a drop softening point of 85° C. was used in place of the polyterpene, the feed roll temperature for drawing was 110° C. and that of the draw roll was 30° C. and the yarn was heat treated in a hot air oven maintained at a temperature of 130° C. under zero tension for 10 minutes. The yarn developed a crimp frequency of 41, had a bicomponent crimp potential of 71 and a Young's modulus of 27 grams/denier and was self-bonding at a temperature of 141° C. Visual inspection of the yarn indicated that no void formation had taken place as a result of the drawing.

EXAMPLE 4

A first component was prepared by blending 18 parts of the pulverized hydrogenated polyterpene resin of Example 1 with 82 parts of the stabilized polypropylene of Example 1 and the blend was extruded into pellets. A second component containing only the stabilized polypropylene was also extruded into pellets.

The above first and second components were then separately melted and fed by separate extruders and metering pumps to a bicomponent fiber spinning head of round cross-section (36-hole spinneret having 0.020 inch diameter orifices) operated at 265° C. and a melt throughput of 23.4 grams/min. and spun as conjugate filaments, the components being disposed side-by-side in a 50:50 relationship. The extrusion temperatures were 240° C. for the blend and 265° C. for the polypropylene. The spun filaments were taken up at the rate of 700 meters/minute and packaged as 8 denier per filament yarns (each yarn containing 36 filaments). The yarn was aged for 48 hours and then drawn 3.0X using differentially driven feed, draw and stabilization rolls, the roll temperatures being 100° C. for the feed roll, room temperature for the draw roll and 135° C. for the stabilization roll, and there being an in-line relaxation chamber maintained at 140° C. and located between the draw and stabilization rolls. The resulting textured yarn had a bulk denier of 150/36 and exhibited a crimp frequency of 10 and a bicomponent crimp potential of about 20.

EXAMPLE 5

Yarn was prepared as in Example 4 with the exceptions herein noted. The polypropylene which was blended with the polyterpene resin was the polypropylene of Example 1 and the polypropylene which was used as the second component was a thermally degraded polypropylene having a molecular weight distribution expressed in terms of the dispersion coefficient Q (ratio of weight average molecular weight to number average molecular weight) of 4, and an intrinsic viscosity of 2.0–2.1. During drawing, the roll temperatures were 55° C. for the feed roll, room temperature for the draw roll and 135° C. for the stabilization roll, the draw roll speed was 300 meters/minute. The yarn of this example had a bulk denier of 131 (3.6 denier/filament) and exhibited a crimp frequency of 12 and a bicomponent crimp potential of about 23. When the yarn of this example was formed into skeins and fabrics and treated with perchloroethylene, the crimp frequency increased to 35.

EXAMPLE 6

Twenty parts of a hydrogenated copolymer of about 30% alpha-methyl styrene and 70% vinyl toluene having a softening point of 135°–140° C., a weight average molecular weight of about 2500 and a bromine number of about 2 were blended with 80 parts of the polypropylene resin of Example 1 and the blend was extruded into pellets.

Pellets of the above blend and pellets containing only the polypropylene were melted separately and fed by separate extruders and metering pumps to a bicomponent fiber spinning head operated at 245° C. and spun as conjugate filaments, the components being disposed in a side-by-side relationship. The spinneret die used in this example was triangular in cross-section and the split between the two components in the fiber cross-section was parallel to one of the bases of the triangle. The ratio of the two components in the fiber cross-section was 50:50. The filaments were spun using a 25X melt draw down and packaged as 54 denier per filament yarns (each yarn containing 48 filaments). The spun yarn was drawn 3.7X using differentially driven feed and draw rolls, the feed roll temperature being 55° C. and the draw roll temperature being at room temperature. The drawn yarns had a denier of 16.0 per filament. The drawn yarns were then heat treated for 1 minute in the relaxed state in a low viscosity silicone oil bath at 125° C. The resulting yarn had a crimp frequency of 15.8 and a bicomponent crimp potential of 63.2.

EXAMPLE 7

The procedure of Example 6 was repeated except that pellets of the degraded polypropylene of Example 5 were substituted for the pellets containing only the polypropylene. The yarn of this example had a crimp frequency of 15.2 and a bicomponent crimp potential of 60.8.

EXAMPLE 8

The procedure of Example 6 was repeated except that the polypropylene used for preparation of the blend was the degraded polypropylene of Example 5. The resulting yarn had a crimp frequency of 28.4 and a bicomponent crimp potential of 113.6.

EXAMPLE 9

The procedure of Example 6 was repeated except that the degraded polypropylene of Example 5 was substituted for the polypropylene used for preparation of the blend as well as for the pellets containing only the polypropylene. The resulting yarn had a crimp frequency of 23.0 and a bicomponent crimp potential of 92.0.

EXAMPLES 10–12

The procedure of Example 9 was repeated except that the amount of hydrogenated copolymer of alpha-methyl styrene and vinyl toluene was varied from 10 to 20% by weight of the blend, the spinning temperature was 260° C. and the spun yarns were drawn 3.0X, giving a denier per filament of 18.8. The composition of the blends and the crimp values obtained following heat treatment for one minute in the relaxed state in a low viscosity silicone oil bath at 125° C. for the yarns of these examples are tabulated below.

| | Composition of Blend (%) | | Yarn Properties | |
|---|---|---|---|---|
| Ex. No. | Copolymer | Polypropylene | Crimp Frequency | Bicomponent Crimp Potential |
| 10 | 10 | 90 | 5.8 | 25.1 |
| 11 | 15 | 85 | 17.1 | 74.1 |
| 12 | 20 | 80 | 18.1 | 78.5 |

EXAMPLE 13

The procedure of Example 12 was repeated except that the pellets of polypropylene (used as the other component) contained 5% by weight of the hydrogenated copolymer of alpha-methyl styrene and vinyl toluene and the pellets were formed by blending the copolymer and polypropylene and then extruding in the same manner used for the first component. The resulting yarn had a crimp frequency of 15.3 and a bicomponent crimp potential of 66.3.

EXAMPLES 14–17

Example 12 was repeated except that spinneret dies of different cross-sectional shapes were used, the feed and draw rolls were both maintained at room temperature and the yarn following drawing was heat treated for one minute in the relaxed state in water at 95° C. instead of silicone oil. Details of these examples and the properties of the resulting yarns are set forth below. Photomicrographs of the crimped filaments in cross-section showed that in each example, the split between the two components of the filament was essentially straight.

| Example No. | Die Shape[1] | Area Ratio of Blend Component I/Component II | Denier per Filament[1] | Crimp Frequency[1] | Bicomponent Crimp Potential |
|---|---|---|---|---|---|
| 14 | Round | 50/50 | 5.73 | 31.3 | 74.9 |
| 15 | Round | 40/60 | 5.73 | 26.8 | 64.2 |
| 16 | Rounded delta | 50/50 | 6.03 | 30.7 | 75.4 |
| 17 | Elliptical (1:2 axis ratio; split along | 50/50 | 6.44 | 52.2 | 132.5 |

-continued

| Example No. | Die Shape[1] | Area Ratio of Blend Component I/Component II | Denier per Filament[1] | Crimp Frequency[1] | Bicomponent Crimp Potential |
|---|---|---|---|---|---|
| | major axis) | | | | |

[1]Determined from photomicrographs.

examples 18–21

The procedure of Example 6 was repeated except that the amount of hydrogenated copolymer of alpha-methyl styrene and vinyl toluene was varied from 15 to 20% by weight of the blend, the spinning temperature was 260° C., the temperature of the feed and draw rolls was maintained at 105° C., the drawn yarns had a denier of 14.6 per filament and, in the case of Examples 20 and 21, one or both components contained 0.4% of a pigment mixture consisting of 18% quinacridone violet, 80% copper phthalocyanine blue and 2% furnace black. Details of these examples and the properties of the resulting yarns are set forth below.

| Ex. No. | Component I (blend) Copolymer Content (%) | Component I (blend) Pigment | Component II (Polypropylene Pigment | Yarn Crimp Frequency | Yarn Bicomponent Crimp Potential |
|---|---|---|---|---|---|
| 18 | 20 | No | No | 10.3 | 39.4 |
| 19 | 15 | No | No | 6.6 | 25.2 |
| 20 | 15 | No | Yes | 6.8 | 26.0 |
| 21 | 15 | Yes | Yes | 6.9 | 26.4 |

EXAMPLES 22–24

The procedure of Example 9 was repeated except that both components contained 0.5% of titanium dioxide and 20 parts of the following hydrocarbon resins were substituted for the copolymer of Example 6 in the formation of the blend.

Example 22 — hydrogenated copolymer of about 77% of of dicyclopentadiene and about 23% of styrene having a softening point of about 135° C. and a number average molecular weight between 500 and 1000.

Example 23 — hydrogenated aromatic hydrocarbon resin derived from petroleum sources and having a softening point of 140° to 150° C. and a molecular weight of about 1000.

Example 24 — non-hydrogenated, low molecular weight aliphatic hydrocarbon resin derived largely from mixed monomers of petroleum origin, having a ring and ball softening point of about 100° C. and a bromine number of 27.

The properties of the yarns of these examples are tabulated below.

| Ex. No. | Denier per Filament | Crimp Frequency | Bicomponent Crimp Potential |
|---|---|---|---|
| 22 | 8.73 | 31.3 | 92.4 |
| 23 | 8.00 | 30.6 | 86.5 |
| 24 | 8.25 | 26.4 | 75.8 |

EXAMPLE 25

The procedure of Examples 22–24 was repeated except that: the hydrocarbon resin was a hydrogenated polystyrene having a drop softening point of about 132° C., and a number average molecular weight of about 1000; the spinning die had a "Y" configuration; the spinning temperature was 220° C.; the spun filaments were taken up at a speed of 215 meters/minute and simultaneously drawn by running the filaments between differentially driven feed and draw rolls maintained at 75° C. and room temperature respectively, and having a speed ratio of 3.5; the yarn, following drawing, was heat treated for one minute in the relaxed state in silicone oil at 120° C.; and the drawn yarn had a denier of 14.4 per filament. The heat treated yarn of this example developed helical crimps and gave a crimp frequency of 18.3 and a bicomponent crimp potential of 69.5.

What we claim and desire to protect by Letters Patent is:

1. A conjugate filament capable of spontaneous crimping comprised of at least two components, one of said components being a blend of stereoregular polypropylene and from 5 to about 50% of at least one hard, non-crystalline resin compatible with said polypropylene and having a drop softening point of at least 70° C. and another of said components being stereoregular polypropylene or a blend of said polypropylene and up to 50% of at least one of said resins, said resins being selected from the group consisting of low molecular weight resins derived from hydrocarbons having at least 4 carbon atoms and rosin derivatives, and, if present in two or more of said components, the amount thereof in the respective blends differing from each other by at least 5%.

2. The filament of claim 1 wherein the hard resin is the glycerin ester of hydrogenated rosin.

3. The filament of claim 1 which is a bicomponent filament and wherein one component is a blend of polypropylene and from about 10 to about 25% of a hard resin selected from the group consisting of terpene polymers, hydrogenated styrene polymers and petroleum resins, and the other component is polypropylene.

4. The filament of claim 3 wherein the hard resin is an aliphatic hydrocarbon resin derived from mixed monomers of petroleum origin.

5. The filament of claim 3 wherein the hard resin is a hydrogenated aromatic hydrocarbon resin derived from petroleum sources.

6. The filament of claim 3 wherein the hard resin is a hydrogenated polyterpene.

7. The filament of claim 3 wherein the hard resin is a hydrogenated styrene polymer.

8. The filament of claim 7 wherein the styrene polymer is a copolymer of alpha-methyl styrene and vinyl toluene.

9. The filament of claim 7 wherein the styrene polymer is a copolymer of styrene and dicyclopentadiene.

10. The filament of claim 7 wherein the styrene polymer is polystyrene.

11. The filament of claim 3 wherein the polypropylene of one or both components is degraded polypropylene.

12. The filament of claim 1 which is a bicomponent filament and wherein one component is a blend of stereoregular polypropylene and from about 15 to about 25% of a hard resin selected from the group consisting of terpene polymers, hydrogenated styrene polymers and petroleum resins and the other component is a blend of stereoregular polypropylene and from about 5 to about 10% of said hard resin.

* * * * *